US006837168B1

(12) United States Patent
Goldbeck et al.

(10) Patent No.: US 6,837,168 B1
(45) Date of Patent: Jan. 4, 2005

(54) INDEXER WITH SELF-POWERED CARRIAGE

(75) Inventors: Bradley J. Goldbeck, Delano, MN (US); Calvin J. Brandt, Delano, MN (US); Kenneth D. Fritz, Monticello, MN (US)

(73) Assignee: Calbrandt, Inc., Delano, MN (US)

( * ) Notice: Subject to any disclaimer, the term of this patent is extended or adjusted under 35 U.S.C. 154(b) by 27 days.

(21) Appl. No.: 10/615,105

(22) Filed: Jul. 8, 2003

(51) Int. Cl.[7] ..... B61J 3/00
(52) U.S. Cl. ..... 104/162; 104/172.3; 104/176
(58) Field of Search ..... 104/162, 172.3, 104/165, 173.1, 176, 163; 414/359; 198/746

(56) References Cited

U.S. PATENT DOCUMENTS 4,006,691 A 2/1977 Kacir et al.
4,354,792 A 10/1982 Cornish
5,709,153 A * 1/1998 Brandt ..... 104/162
6,267,059 B1 7/2001 Brandt
6,389,984 B2 * 5/2002 Brandt ..... 104/162
6,553,916 B2 4/2003 Goldbeck
6,668,730 B2 * 12/2003 Goldbeck ..... 104/162

* cited by examiner

*Primary Examiner*—Mark T. Le
(74) *Attorney, Agent, or Firm*—Nikolai & Mersereau, PA; C. G. Mersereau

(57) ABSTRACT

The present invention provides a reversing train positioning system for engaging and moving a railroad car or trip of cars by engaging a bogey wheel truck frame. The train positioning system includes a dog carriage having a drive motor mounted on the dog carriage which operates to propel the dog carriage back and forth along a single tension chain in a carriage guideway provided alongside a railroad track. The carriage is supplied with electric power and hydraulic fluid from an attached flexible power track system which has a fixed end connected to a source of high pressure hydraulic fluid and a return sump and a source of electric power and a free end attached to move with the carriage. Alternatively, the entire hydraulic system may be carried on board the carriage.

19 Claims, 8 Drawing Sheets

INDEXER WITH SELF-POWERED CARRIAGE

BACKGROUND OF THE INVENTION

I. Field of the Invention

The present invention relates generally to train positioning systems, particularly to systems for indexing a coupled string or trip of cars through a work station, one or more cars at a time during loading or unloading endeavors. More specifically, the present invention is directed to such a system which includes dog carriages having on-board drive systems to operate the carriages along a single tension chain. The system includes converging, diverging, separately-operated, horizontally extending cantilevered car engaging and propelling dogs designed to operate from one side against car bogey wheel frames.

II. Related Art

Trains, many containing 100 or more cars of identical or a variety of sizes, have long been acknowledged as desirable and efficient carriers of bulk raw materials such as coal, iron ore, limestone, various finely divided dry bulk agricultural products including grains, etc., and liquid or dry chemicals. These cars are typically filled from above and may be emptied using a rotary car dumper in the case of coal or iron ore. Liquid bulk cargo is typically unloaded by connecting outlets to large hoses with associated pumping equipment and opening bottom drain valves. The cargo then being pumped into tanks or tank trucks located near the tracks.

Cars shipping bulk agricultural products are bottom emptied into stationary freight handling equipment such as chutes, conveyor handlers or the like. These cars may be provided with a number of spaced bottom discharging hopper bins or chutes accessing the main storage volume of the car enclosed by sliding discharge gates. These are designed to be precisely positioned over dedicated recessed receiving facilities situated at fixed stations such as grain or coal bins and conveyors positioned beneath the railroad track.

In the bottom discharge operation, a connected train engine roughly positions one end of a string of cars to be unloaded close to the unloading facility. Because train engines are not well suited for indexing or precisely positioning individual cars or even sets of cars along the track, let alone precisely over individual bins, train positioning devices known as railroad car progressors or indexers have been built and operated at fixed stations.

Railroad car indexers of the class of interest include at least one car engaging and propelling member or "dog" for engaging at least one railroad car in a string or trip of cars and moving the string a given distance along the railroad track. The engaging members often situated and operated along an auxiliary indexer track or guideway juxtaposed in parallel relation to the railroad track in the fixed receiving facility. Fluid operated actuators such as hydraulic cylinders or chains and sprockets driven by hydraulic or electric motors supply power for moving the dog and pulling the railroad cars. U.S. Pat. No. 4,006,691, issued to Kacir et al, and U.S. Pat. No. 4,354,792, issued to Cornish, show train positioners that approach the train from alongside the track and including an engaging member arm which engages a car coupler from above.

It is known to provide a train positioning system having one or more carriages which include a pair of horizontally pivoting dogs mounted in opposed spaced relation and adapted to such that a first dog engages and moves a bogey frame in a first direction and a second dog engages and moves a bogey frame in the opposed direction. Such a system is illustrated and described in U.S. Pat. No. 6,267,059 to Brandt, a co-inventor in the present application.

It is also known to operate dog-carrying, train-positioning carriages using a reversing chain drive which includes an over/under or vertical sprocket drive system in which the gears and chain are at least partially enclosed to reduce exposure of the mechanism to the elements and the buildup of foreign materials. A system such as this is illustrated and described in U.S. Pat. No. 6,553,916 B2 to Goldbeck, a co-inventor in the present application.

While these prior systems have met with success, a need has also existed to simplify carriage drive systems that move the carriages and the system that operate the dogs. The present invention provides a dog carriage with an on-board drive system that requires only a single strand of tension drive chain. Separate, direct dog operation is also provided.

SUMMARY OF THE INVENTION

The present invention provides a reversing train positioning system for engaging and moving a railroad car or trip of cars by engaging a bogey wheel truck frame. The train positioning system includes a dog carriage having a drive motor mounted on the dog carriage which operates to propel the dog carriage back and forth along a single tension chain in a carriage guideway provided alongside a railroad track. In one embodiment, the carriage is supplied with electric power and hydraulic fluid from an attached flexible power track system which has a fixed end connected to a source of high pressure hydraulic fluid and a drain and a source of electric power and a free end attached to move with the carriage. In an alternate embodiment, the hydraulic system is carried on the carriage and the track system supplies power only.

Each dog carriage also is provided with a pair of spaced, horizontally-pivoting dog members, each directly operated by a linear fluid actuator to pivot between a deployed, bogey wheel truck frame engaging position and a retracted or stored position. The dogs are preferably mounted in opposed spaced relation so that they can pivot toward each other and converge on a bogey frame from both sides, if desired. In one preferred arrangement, each pivoting dog is attached to the rod end of a double-acting hydraulic cylinder in a manner such that when the dog is fully deployed to push against the bogey wheel truck frame, the rod is fully retracted. In this manner, the force of the fluid retracting the cylinder controls the maximum force that can be exerted by the dog against a bogey frame. When the force needed to move a trip of cars exceeds the amount exerted by the cylinder rod end fluid, the cylinder rod is free to extend and the dog will be pushed out of the way without damage. The working pressure, of course, can be adjusted as desired. Proximity detectors or limit switches are provided to verify the position of each dog at all times and the dogs are preferably designed to operate in an entirely separate and independent manner.

Each carriage of the reversing train positioning system of the invention is also provided with a non-contact system for detecting the presence and location of a proximate bogey wheel truck frame. The detection, acquisition or hunting process proceeds with both dogs in the retracted position. The retraction of the dogs is verified by position verification devices prior to the initiation of the hunting mode. The appropriate dog can then be deployed in a timely manner to engage the bogey wheel truck frame.

The drive motor is preferably a conventional reversing hydraulic motor with associated drive unit which operates a revolving output sprocket or gear which, in turn, positions the dog carriage along a single strand tension chain situated in the carriage guideway. Chain tension is maintained by a pair of pneumatic (reservoir fed) cylinders located at the ends of the guideway. The system is preferably charged with high pressure nitrogen at perhaps 1500 psi. The system is designed to operate generally with the cylinder rods fully extended to eliminate slack and to provide for the most accurate positioning. At least one of the cylinders is provided with a linearly adjustable mounting system such that the chain can be easily loosened for removal and installation and all slack thereafter removed. This adjustment may be accomplished utilizing a threaded adjustment member which operates in the manner of a large take-up or toggle bolt.

BRIEF DESCRIPTION OF THE DRAWINGS

In the drawings wherein like numerals depict like parts throughout the same.

DETAILED DESCRIPTION

At the outset, in accordance with describing aspects of one or more embodiments of the invention, it should be noted that the detailed descriptions are intended by way of example and are not intended by way of limitation with respect to any part of the invention. The embodiments of the invention can be modified while remaining in keeping with the inventive concepts.

One important aspect of the train positioning or indexing system of the present invention is the simplification of the drive system from one requiring a fully circumferential chain system including multiple idler sprockets and other associated drive parts to one which operates along a single strand of tension chain utilizing only three vertical sprockets located very close to the drive motor. The single strand of tension drive chain is, for the most part, concealed within the railcar positioner guideway. This arrangement also reduces the exposure of operating personnel and others in the vicinity to moving parts as the motor and gears are mounted on and move with the carriage.

Figure 1:
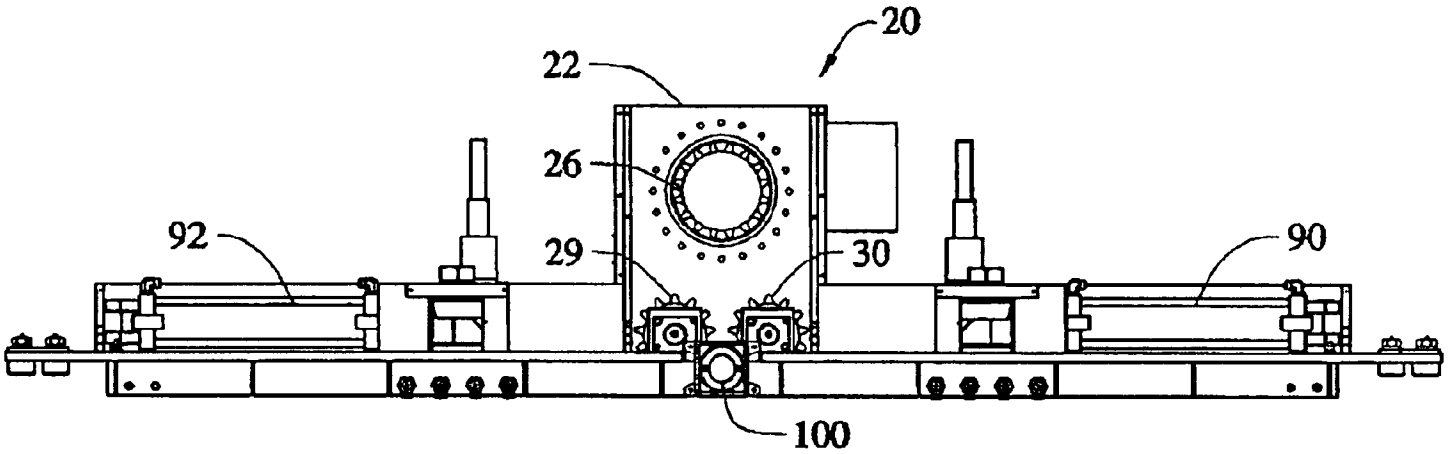
FIG. 1 is a front elevational view of a train positioner dog carriage in accordance with the invention with parts removed for clarity.
Figure 5:
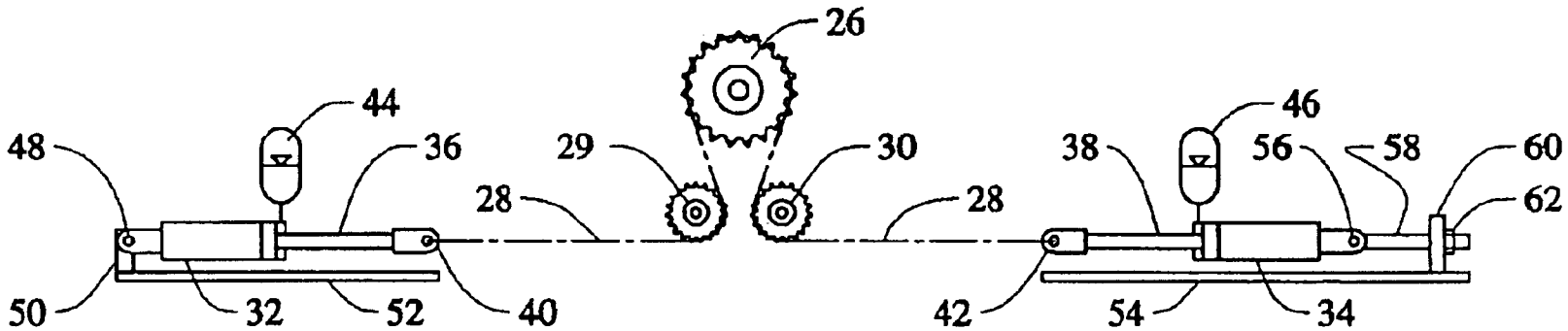
FIG. 5 is a schematic diagram of a drive chain tension control system in accordance with the invention.

FIG. 1 depicts a front elevational view of a dog carriage configured in accordance with the present invention. The carriage is shown generally at 20 which carries a motor housing 22 in which a hydraulic motor 24 (FIGS. 2*a*–2*c*) is mounted with a conventional associated drive unit and brake system 25 having an output shaft carrying an associated output sprocket 26 which may be mounted and keyed in a well known manner or it may be machined as an integral part of the output shaft itself as in the detailed embodiment. As shown in the drawings, the output sprocket or drive gear 26 is associated with a pair of idler gears or sprockets 29 and 30 which with sprocket or gear 26 carry a single strand tension chain 28 as shown in the schematic of FIG. 5. As also shown in the schematic of FIG. 5, the system includes a stationary cylinder 32 and an adjustably mounted cylinder 34, shown with corresponding respective piston rods 36 and 38 fully extended and attached as by clevis joints 40 and 42 to the single strand tension drive chain 28.

Chain tension control is maintained by closed systems associated with each of the cylinders 32 and 34. Thus, cylinder 32 is provided with a connected closed system pressurized reservoir 44 containing an amount of pressurizing gas which is preferably nitrogen. Likewise, cylinder 34 has a similar associated reservoir 46. The reservoirs 44 and 46 are connected to pressurize the rod end of the cylinders 32 and 34, respectively. These systems maintain a minimum amount of tension in the chain 28 of the reversible drive system.

Cylinder 32 is mounted in a fixed horizontal disposition as by pivot joint 48 connected by gusset 50 to a base member 52. Adjustable cylinder 34 rides on a base 54 and is attached at 56 to a threaded rod member 58 which extends through an opening in a plate member 60 and is threaded on to an adjusting hex nut 62 such that the relative position of cylinder 34 may be adjusted laterally by rotating the nut 62 on the threaded member 58 in a well known manner to loosen the chain for removal and replacement and to make sure the rods 36 and 38 are in the fully extended positions for operation of the system at installation.

Rotation of the output sprocket or gear 26 in a desired direction then propels the entire carriage along the guideway as desired by moving the system along the chain 28. Any directional chain slack is taken up by the tension control systems automatically.

Figure 2A:
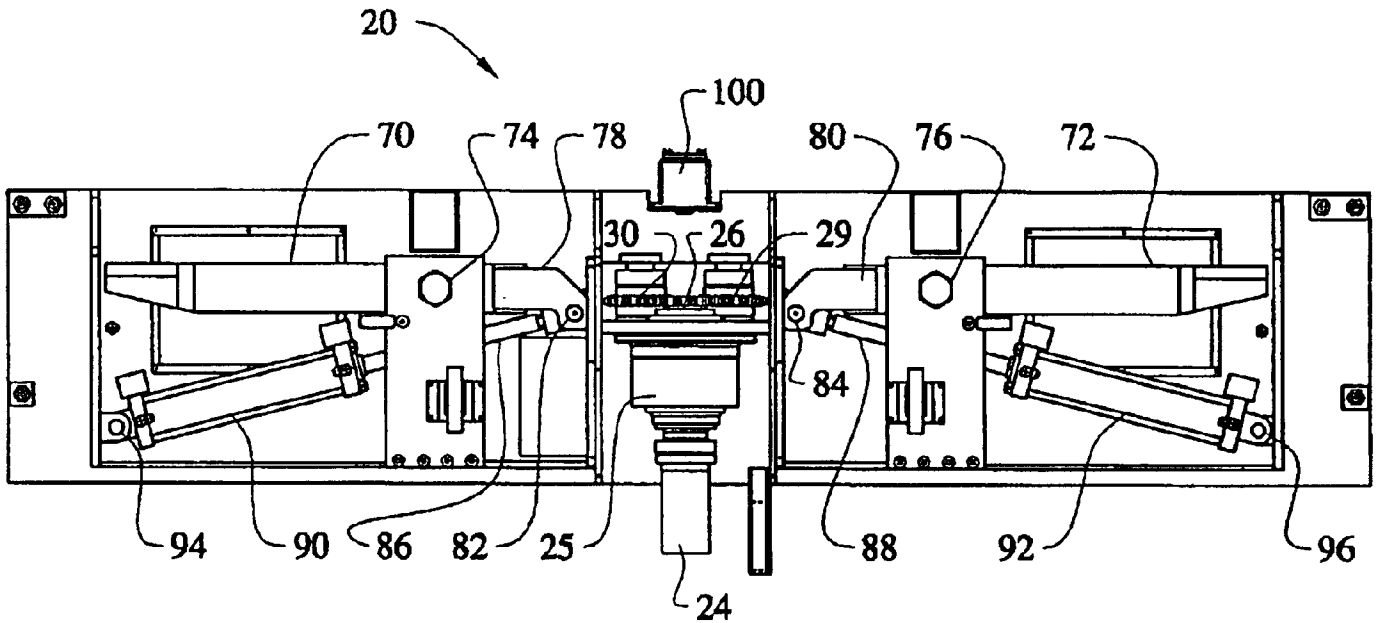
FIG. 2*a* is a partial top view of a dog carriage as in FIG. 1 with both dogs in the fully retracted position and some parts removed for clarity.
Figure 2B:
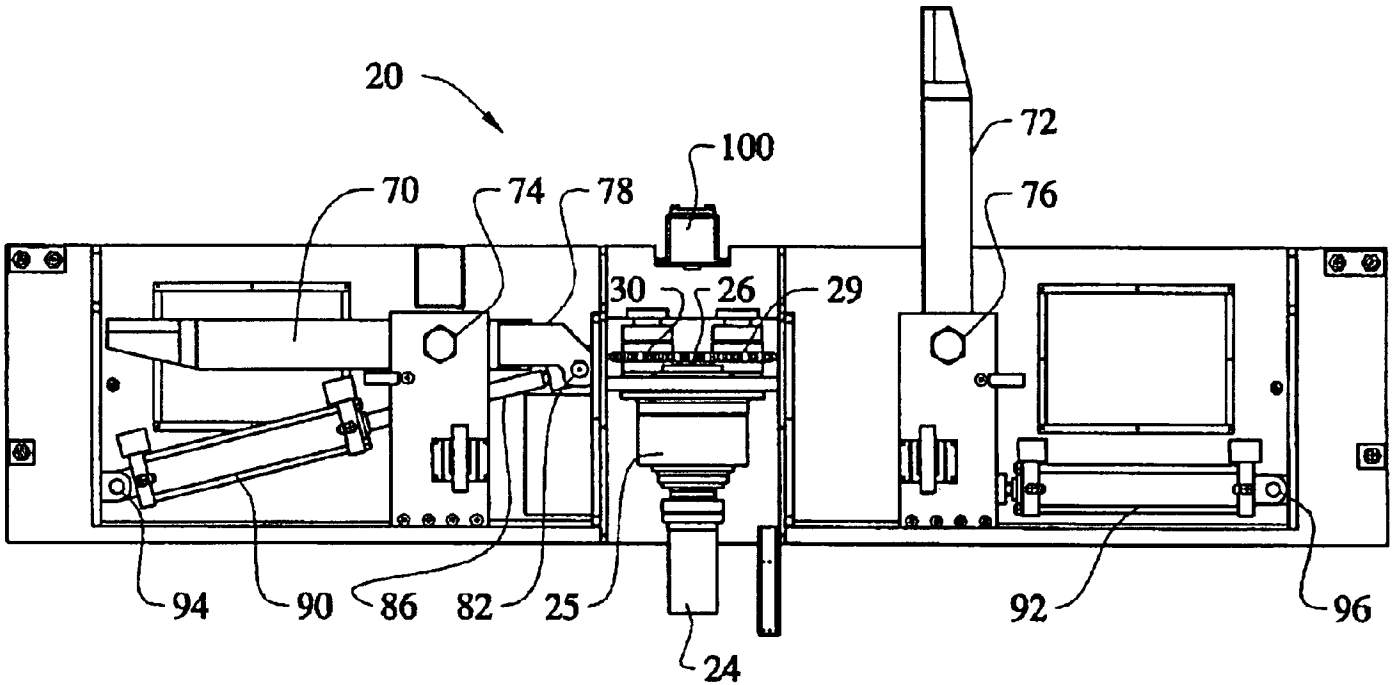
FIG. 2*b* is a figure similar to FIG. 2*a* with one dog deployed.
Figure 2C:
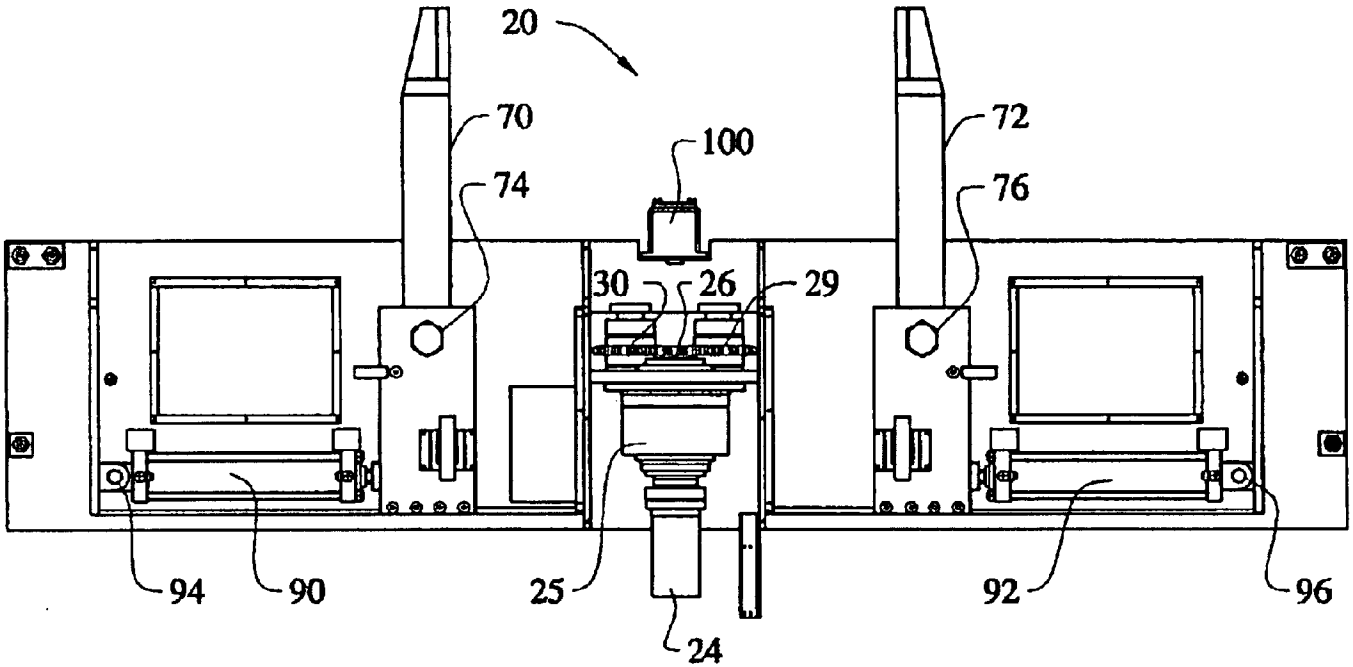
FIG. 2*c* is a view similar to that of FIGS. 2*a* and 2*b* depicting the dog carriage with both dogs deployed.

As best seen in FIGS. 2*a*–2*c*, the carriage also includes a pair of oppositely disposed bogey wheel frame engaging horizontally pivoting dogs 70 and 72, respectively mounted to pivot about shafts 74 and 76, respectively. The dogs 70 and 72 are mounted to rotate and converge toward each other when they are deployed. The dogs 70 and 72 include respective tail sections 78 and 80 which, in turn, are connected at respective pivot joints 82 and 84 to pivot rods 86 and 88 of respective fluid cylinders 90 and 92 which, in turn, have their cylinder ends pivotally mounted at 94 and 96. FIG. 2*a* depicts both dogs in the fully retracted or stored position. FIG. 2*b* depicts the dog 72 deployed and the dog 70 retracted and FIG. 2*c* depicts both dogs deployed. Note that the rods 86 and 88 are fully retracted when the corresponding dogs 70 and 72 are fully deployed so that the corresponding dog pushes against a bogey frame, the corresponding cylinder provides a stop for the pivoting of the dog. Thus, dog 70 is designed to push to the right and dog 72, to the left. In addition, it is clear that, as shown, the dogs 70 and 72 operate separately and independent of each other.

Also mounted on the carriage 20 is a sensing device depicted by reference character 100 which may be any type of suitable proximity detecting or optical detection device which can be used to detect the presence of a bogey frame opposite the dog carriage 20. Thus, because standard dimensions are utilized in railway cars, the detector 100 can be used to detect either the frame itself or a corresponding wheel mounted on the bogey truck frame. Many such devices are well known and such units may be purchased and mounted on the system as desired. Signals from the detection unit 100 are used to control aspects of the operation of the dogs 70 and 72.

Figure 3:
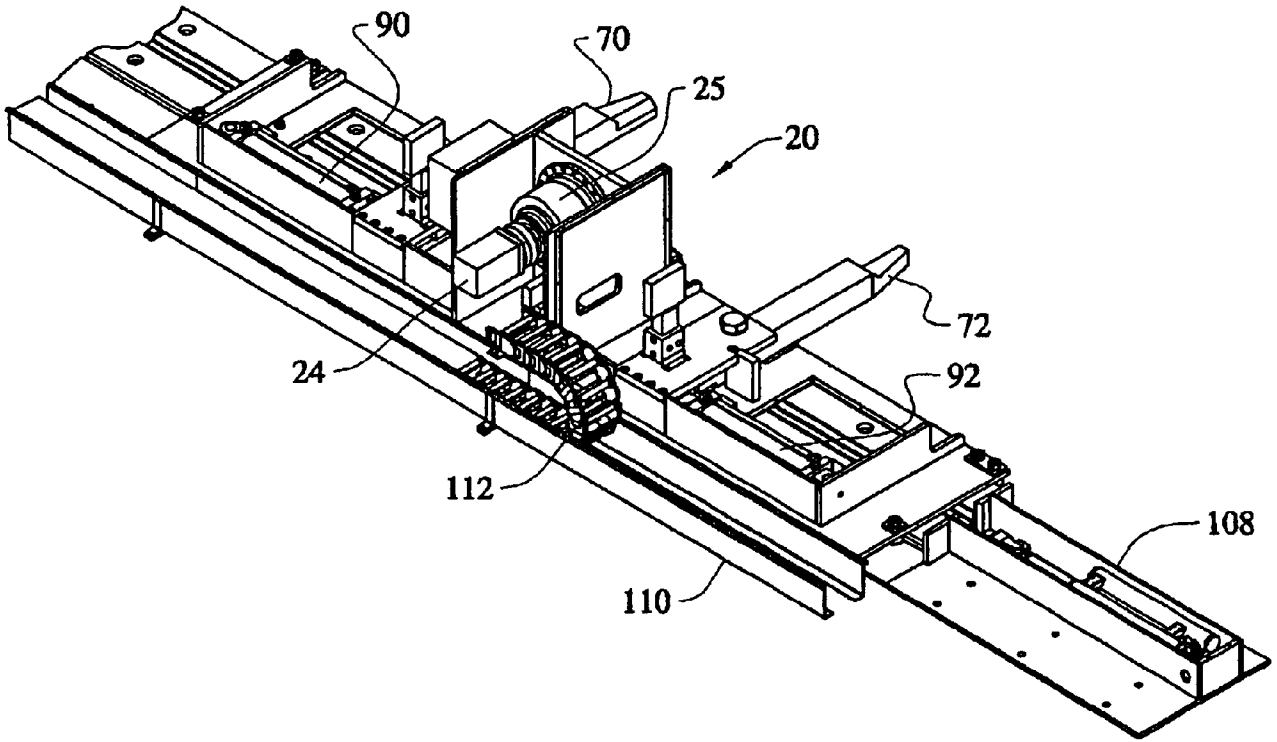
FIG. 3 is a fragmentary perspective view of a train positioning system including a dog carriage as in FIG. 2*b* with one dog deployed, but including part of a guideway and part of the flexible track supply system.
Figure 4:
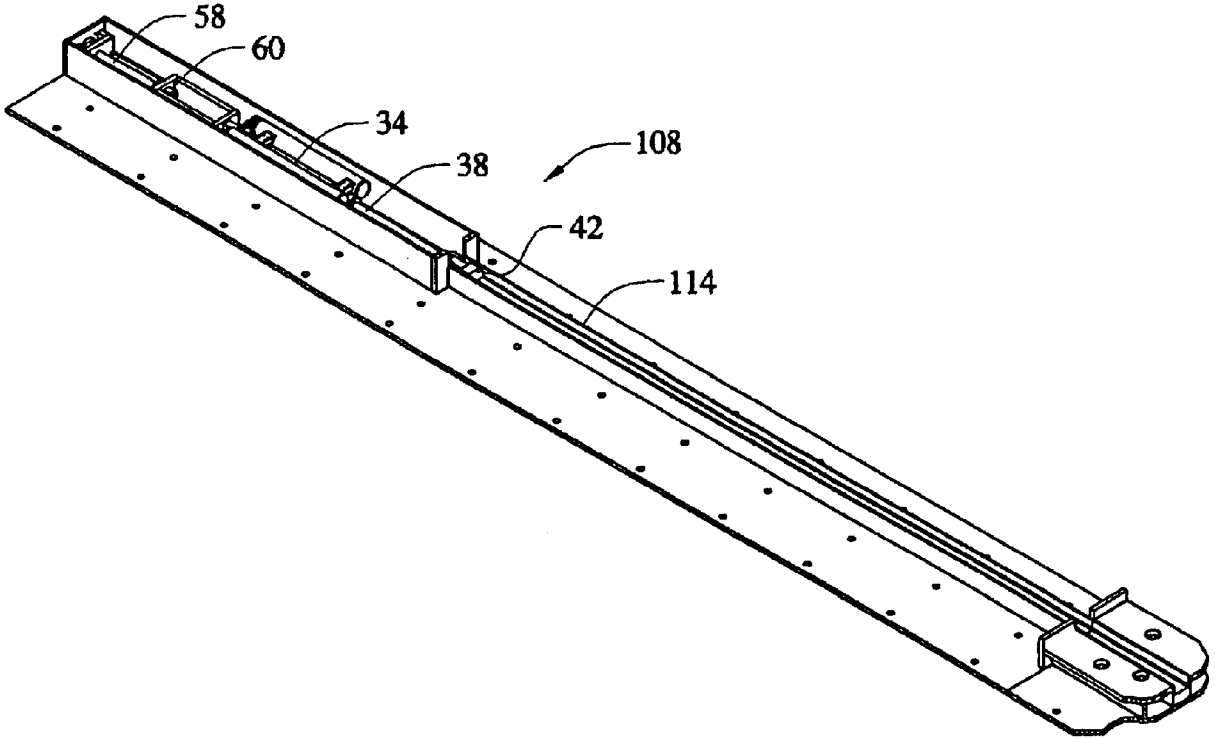
FIG. 4 is a fragmentary view of part of the guideway of the train positioner of the invention showing a linearly adjustable cylinder mount.

FIG. 3 depicts a schematic view of the carriage 20 and includes one end of a guideway 108 in which the carriage runs. FIG. 4 shows the opposite end of the guideway 108 and includes the adjustable cylinder system. FIG. 3 further depicts the flexible track power or pickup system which includes a power track guideway in which a flexible articulated track 112 operates as the dog carriage 20 reciprocates along guideway 114. The articulated flexible track 112 contains a series of connected links which carry flexible electric power cable and supply and drain hydraulic hoses (not shown). Electricity and hydraulic supply fluid and return lines are supplied to the cable and hoses at a stationary end also not shown.

Figure 6:
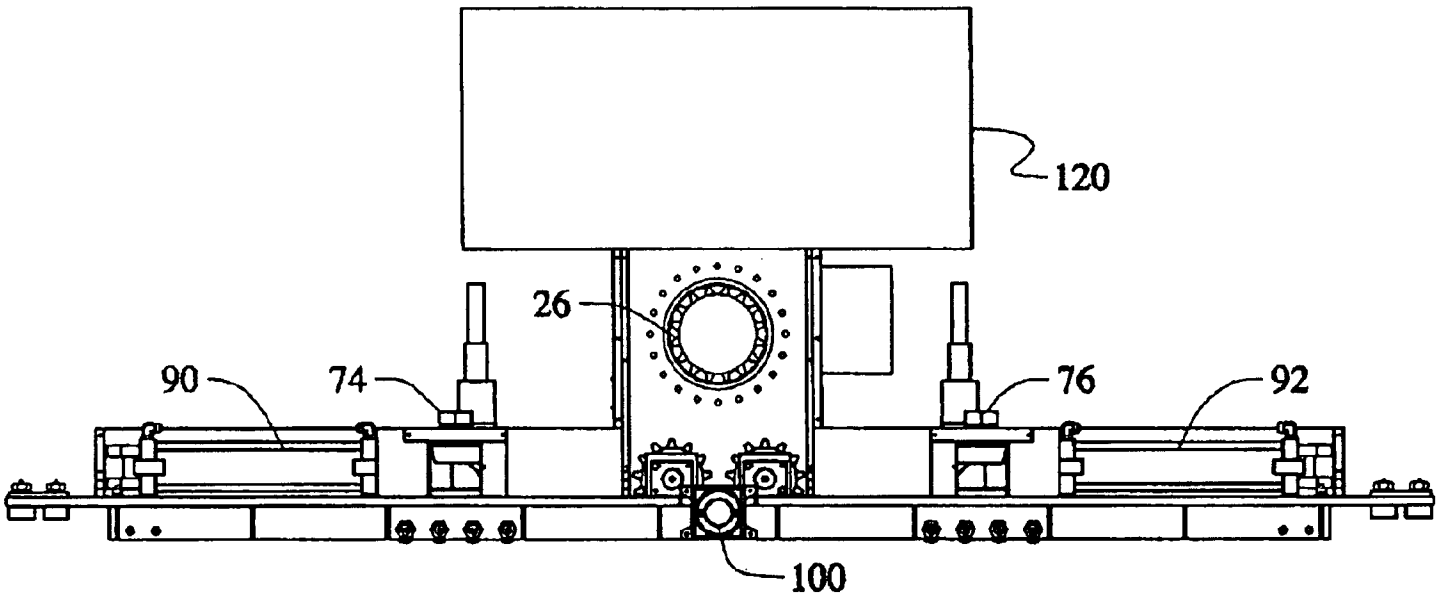
FIG. 6 is a front elevational view of an alternate embodiment of a train positioner dog carriage in accordance with the invention with parts removed for clarity.

FIG. 6 is a front elevational view of an alternate embodiment of a train positioner dog carriage in accordance with the invention that is substantially similar to that previously described except that the hydraulic system is carried on board the carriage as depicted by the large object 120. The hydraulic system, of course, as is well known, contains the sump or supply of hydraulic fluid, together with the requisite filters and high pressure pump which connects to the pressurizing lines and includes connections for all return lines to the supply reservoir or sump. As indicated, these devices are known and, it is believed, need not be illustrated and further described in detail as they themselves do not form part of the present invention. The advantage of carrying the hydraulic system 120 on board the carriage, however, is an important aspect as it eliminates the requirement for hydraulic lines to be included in the supply track 112 which consequently needs only supply electric power to the system. The self-contained on-board system presents a definite operational and maintenance advantage over the use of connected fluid supply lines.

This invention has been described herein in considerable detail in order to comply with the Patent Statutes and to provide those skilled in the art with the information needed to apply the novel principles and to construct and use such specialized components as are required. However, it is to be understood that the invention can be carried out by specifically different equipment and devices, and that various modifications, both as to the equipment details and operating procedures, can be accomplished without departing from the scope of the invention itself.

What is claimed is:

1. A reversing train positioning system for engaging and moving a railroad car or a trip of coupled cars by engaging bogey wheel truck frames from one side comprising:

(a) a dog carriage guideway spaced from and parallel to a railroad track;

(b) a dog carriage mounted to operate along said guideway;

(c) a carriage drive system including a motor mounted on said dog carriage for operating said dog carriage along said guideway;

(d) a first dog member pivotally attached to said dog carriage mounted to pivot in a generally horizontal plane between a retracted position and an extended position wherein said first dog member is positioned to engage a proximate bogey wheel truck frame in a first direction and be deflected by said bogey frame in said first direction in the event that a force limit is exceeded;

(e) a second dog member pivotally attached to said dog carriage in opposed spaced relation to said first dog member mounted to pivot in a generally horizontal plane between a retracted position and an extended position wherein said second dog member is positioned to engage said bogey wheel truck frame in a second direction and be deflected by said bogey frame in said second direction in the event that a force limit is exceeded;

(f) a first actuating device for pivoting said first dog member;

(g) second actuating device for pivoting said second dog member, whereby said first and second dogs and actuating devices operate independently; and (h) flexible supply system attached to move with said carriage and supply operating power to said carriage.

2. A train positioning system as in claim 1 wherein each dog is operated by a double-acting fluid cylinder and wherein said flexible supply system further supplies operating fluid power to said carriage.

3. A train positioning system as in claim 1 wherein said first and second dogs are mounted to pivot toward each other when deployed.

4. A train positioning system as in claim 2 wherein said first and second dogs are mounted to pivot toward each other when deployed.

5. A train positioning system as in claim 1 wherein each dog is operated by a corresponding fluid cylinder in a manner such that when a dog is fully deployed, a corresponding fluid cylinder rod is fully retracted and the dog pulls against a retracted cylinder rod when engaging a bogey frame and extends said associated cylinder rod when it is deflected by said bogey frame.

6. A train positioning system as in claim 2 wherein each dog is operated by a corresponding fluid cylinder in a manner such that when a dog is fully deployed, a corresponding fluid cylinder rod is fully retracted and the dog pulls against a retracted cylinder rod when engaging a bogey frame and extends said associated cylinder rod when it is deflected by said bogey frame.

7. A train positioning system as in claim 4 wherein each dog is operated by a corresponding fluid cylinder in a manner such that when a dog is fully deployed, the corresponding fluid cylinder rod is fully retracted and the dog pulls against a retracted cylinder rod when engaging a bogey frame and extends said associated cylinder rod when it is deflected by said bogey frame.

8. A train positioning system as in claim 1 wherein said carriage drive system comprises a single tension chain engaged by gears driven by said motor.

9. A train positioning system as in claim 7 wherein said carriage drive system further comprises a tensioning system for controlling tension in said tension chain.

10. A train positioning system as in claim 8 wherein said tension control system further includes a pair of spaced, oppositely disposed pressurized cylinders.

11. A train positioning system as in claim 9 wherein said tension control system further comprises a device for adjusting the relative position of at least one of said cylinders for use in installing said tension chain.

12. A train positioning system as in claim 1 further comprising a non-contact detector for detecting the presence of a bogey frame in the vicinity of said carriage.

13. A train positioning system as in claim 11 wherein said detector is optical.

14. A train positioning system as in claim 11 wherein said detector includes a proximity detecting device.

15. A train positioning system as in claim 1 further comprising detectors for indicating the position of each of said dogs.

16. A train positioning system as in claim 1 wherein said motor is a hydraulic motor.

17. A train positioning system as in claim 1 wherein said carriage further carries a hydraulic system on board.

18. A train positioning system as in claim 5 wherein said carriage further carries a hydraulic system on board.

19. A method of positioning a train using the system of claim 1 including the steps:

(a) using a non-contact detector for detecting the presence of a bogey frame in the vicinity of said dog carriage;

(b) confirming that the dogs are retracted prior to step (a); and (c) deploying a single appropriate dog upon the detection of a proximate bogey frame.

* * * * *